US009116506B2

(12) United States Patent
Ballouard

(10) Patent No.: US 9,116,506 B2
(45) Date of Patent: Aug. 25, 2015

(54) TIMEPIECE

(71) Applicant: Harry Winston SA, Plan-les-Ouates (CH)

(72) Inventor: Ludovic Ballouard, Pougny (FR)

(73) Assignee: Harry Winston SA, Plan-les-Ouates (CH)

( * ) Notice: Subject to any disclaimer, the term of this patent is extended or adjusted under 35 U.S.C. 154(b) by 0 days.

(21) Appl. No.: 14/259,418

(22) Filed: Apr. 23, 2014

(65) Prior Publication Data

US 2014/0321249 A1 Oct. 30, 2014

(30) Foreign Application Priority Data

Apr. 25, 2013 (EP) ..... 13165393

(51) Int. Cl.
*G04B 19/21* (2006.01)
*G04B 19/04* (2006.01)

(52) U.S. Cl.
CPC ..... *G04B 19/21* (2013.01); *G04B 19/04* (2013.01)

(58) Field of Classification Search
CPC ..... G04B 19/00; G04B 19/04; G04B 19/16; G04B 19/21; G04B 25/00; G04B 25/06; G04B 45/00; G04B 45/0038
See application file for complete search history.

(56) References Cited

U.S. PATENT DOCUMENTS 401,697 A * 4/1889 Ethridge ..... 368/231
403,525 A * 5/1889 Ethridge ..... 368/231
5,109,989 A * 5/1992 Kremmin et al. ..... 211/1.55
2008/0028186 A1 1/2008 Casselman
2009/0154298 A1* 6/2009 Taylor et al. ..... 368/77
2011/0013495 A1* 1/2011 Saunier ..... 368/225
2011/0069590 A1* 3/2011 Jolidon ..... 368/15
2011/0125960 A1 5/2011 Casselman
2013/0017516 A1* 1/2013 Tyler ..... 434/114
2013/0149674 A1* 6/2013 Anderson et al. ..... 434/114

FOREIGN PATENT DOCUMENTS

CH 83150 11/1919
FR 890 586 2/1944
WO WO 2008/014494 A2 1/2008

OTHER PUBLICATIONS

European Search Report issued Nov. 20, 2013 in EP application 13165393, filed on Apr. 25, 2013 ( with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece includes a timepiece movement provided with an information display mechanism driven from a power take-off. The display mechanism includes N display members for the information regularly distributed over a perimeter of the movement. The N display members are each pivoted on a drive arbour perpendicularly and can take different first and second radial positions in relation to the center of the movement. The display members are driven in succession over time by a common first annular jumping drive so that each display member changes in succession from the first position to the second position and is held in the second position until the end of a cycle in which all of the display members are in their second position. A second annular drive is arranged to reposition all of the display members in their first position at the start of the following cycle.

5 Claims, 15 Drawing Sheets

BOTTOM SIDE

DIAL SIDE

DIAL SIDE

BOTTOM SIDE

BOTTOM SIDE

BOTTOM SIDE

BOTTOM SIDE

DIAL SIDE

BOTTOM SIDE

TIMEPIECE

This application claims priority from European Patent application No. 13165393.3 filed Apr. 25, 2013, the entire disclosure of which is incorporated by reference.

FIELD OF THE INVENTION

The present invention relates to the field of horology, and more specifically concerns a time display device for a mechanical or electromechanical timepiece, and a mechanism for making this device.

BACKGROUND OF THE INVENTION

In mechanical horology, the time is generally indicated by means of hour and minute hands which move opposite a graduation.

There are state of the art mechanical watches including display devices, particularly for the time, having original features distinguishing them from traditional analogue displays, which mostly include coaxial hour and minute hands at the centre of the movement.

There are known, for example, mechanical timepieces which propose rotatably mounted studs offering different display faces. For example, WO Patent No 20080144948 proposes an embodiment simulating the movement of a display hand. To achieve this, studs are arranged in the normal manner of timepiece display indicators. The stud corresponding to a piece of information to be displayed has a specific surface, whereas the other studs have a uniform surface. For example, the stud signifying the information has a face of a particular colour, whereas the other studs have a different colour. At the next hour change, the specific stud active during the preceding hour is actuated to exhibit the same colour as the other studs. Simultaneously, the stud active in the new hour is also actuated to exhibit a specific colour. Thus, in this embodiment, the studs are actuated at least twice per period, and the result obtained is identical to that of the motion of a hand.

It is an object of the present invention to propose another original display device for indicating, in particular, the hours and/or minutes.

The invention therefore concerns a timepiece including a timepiece movement provided with an information display mechanism driven from a power take-off, said display mechanism including N display members for said information regularly distributed over a perimeter of the movement, characterized in that the N display members are each pivoted on a drive arbour perpendicularly and can take different first and second radial positions in relation to the centre of the movement, the display members being driven in succession over time by common first annular jumping drive means so that each display member changes in succession from the first position to the second position and is held in said second position until the end of a cycle in which all of the display members are in their second position and in that second annular drive means are arranged to reposition all of the display members in their first position at the start of the following cycle.

According to an embodiment, the indicator member takes the form of a hand, the two radial positions of the display members being separated from each other by an angle of 40° in relation to the drive axis, and the successive driving of the display members is accomplished by means of a pin secured to the first annular drive means, the pin being arranged to push a cam integral with the display member, said cam being associated with a jumper spring to define the first and second positions in a stable manner. Preferably, the display member displays time information and the timepiece includes 59 display members each defining a different minute.

BRIEF DESCRIPTION OF THE DRAWINGS

The features of the invention will appear more clearly upon reading the description of a preferred embodiment, given solely by way of non-limiting example with reference to the annexed Figures, in which.

DETAILED DESCRIPTION OF PREFERRED EMBODIMENTS

Figure 1:
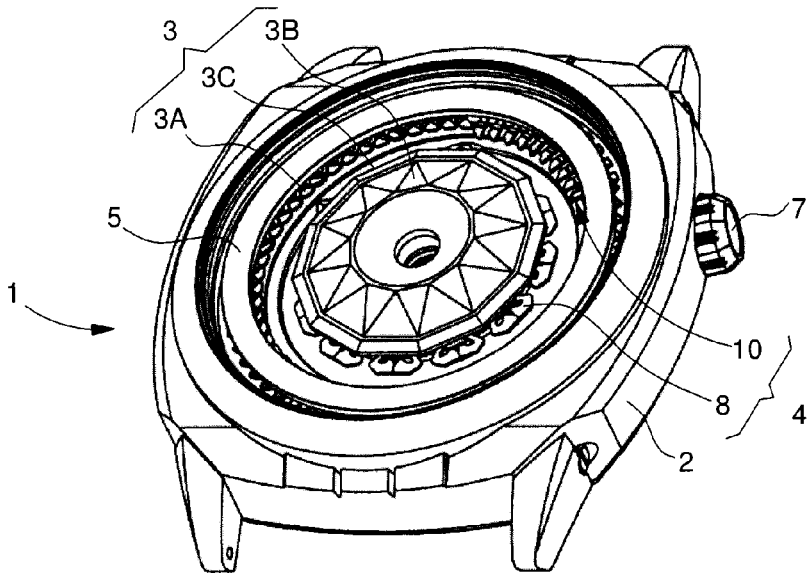
FIG. 1 is a top perspective view of a timepiece according to the invention.
Figure 2:
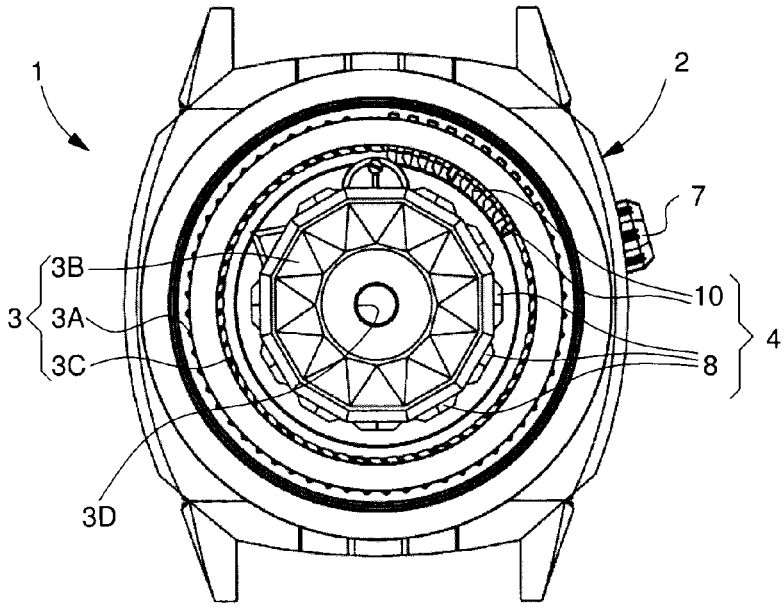
FIG. 2 shows a front view of a timepiece according to the invention.

Referring to FIGS. 1 and 2, there is shown a wristwatch 1 provided with an hour-circle formed of a case 2, formed in a conventional manner, of a middle part and a back cover, containing a dial 3, a time display device 4 according to the invention, a movement MVT, a crystal 5 and a crown 7.

Time display device 4 includes eleven hour hands 8 rotating on themselves through 180° opposite an hour-circle, with the exception of the 12 o'clock hand. The eleven hour hands are triangular and extend in the plane of the dial. They are pivoted on drive arbours extending perpendicularly to dial 3. The time is indicated by the orientation of the apex of the triangle in an external radial direction. Only one hand 8 of the eleven hands can occupy this position at a given moment.

The arbour of the 12 o'clock hand carries a disc on which there is hinged a connecting rod whose other end is connected to a hatch sliding in translation in a fixed guide structure. The hatch has a circular aperture. The disc, like the hands, can occupy two fixed positions determined by the hand drive system. The hatch device is actuated at midday and at midnight for a period of one hour and reveals an indication, for example a logo, in the hatch aperture.

The minute display is achieved by means of fifty-nine hands 10 which are mounted on arbours perpendicular to dial 3. These hands 10 rotate over an angle of 40°. The two end positions of these hands 10 correspond to a display position visible to the user of the watch and to a retracted position in which hands 10 are concealed by dial 3. The last minute is indicated by simultaneously resetting the fifty-nine hands 10. The minute reading corresponds to the number of minute hands 10 oriented in a determined radial position.

The hour and minute display are driven by means of two jumping devices, and the minute display is provided with a retrograde drive system.

Dial 3 is partially transparent and includes a peripheral annular area 3A and a central area 3B which are opaque and delimit between them a transparent annular area 3C. The opaque central area 3B is in relief in the illustrated example and takes the form of a faceted crown. Dial 3 has a central aperture 3D where a transparent portion cooperates with the hatch and reveals the top of the movement. At midday and at midnight the hatch aperture is superposed on the dial aperture to reveal the logo. Preferably, the dial is treated with an anti-reflective coating. In the visible display position, minute hands 10 appear in the transparent annular area 3C of dial 3.

With reference to the Figures, the movement and drive mechanism of these various display devices carried by plate P of the movement will be described.

Figure 3:
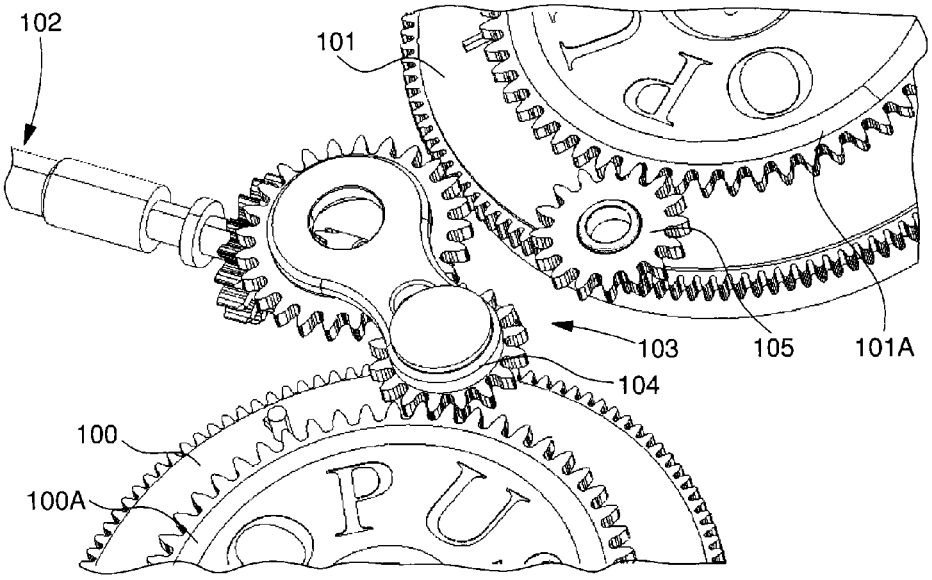
FIG. 3 shows a perspective view of a detail of the barrel winding mechanism of the timepiece movement according to the invention.
Figure 11:
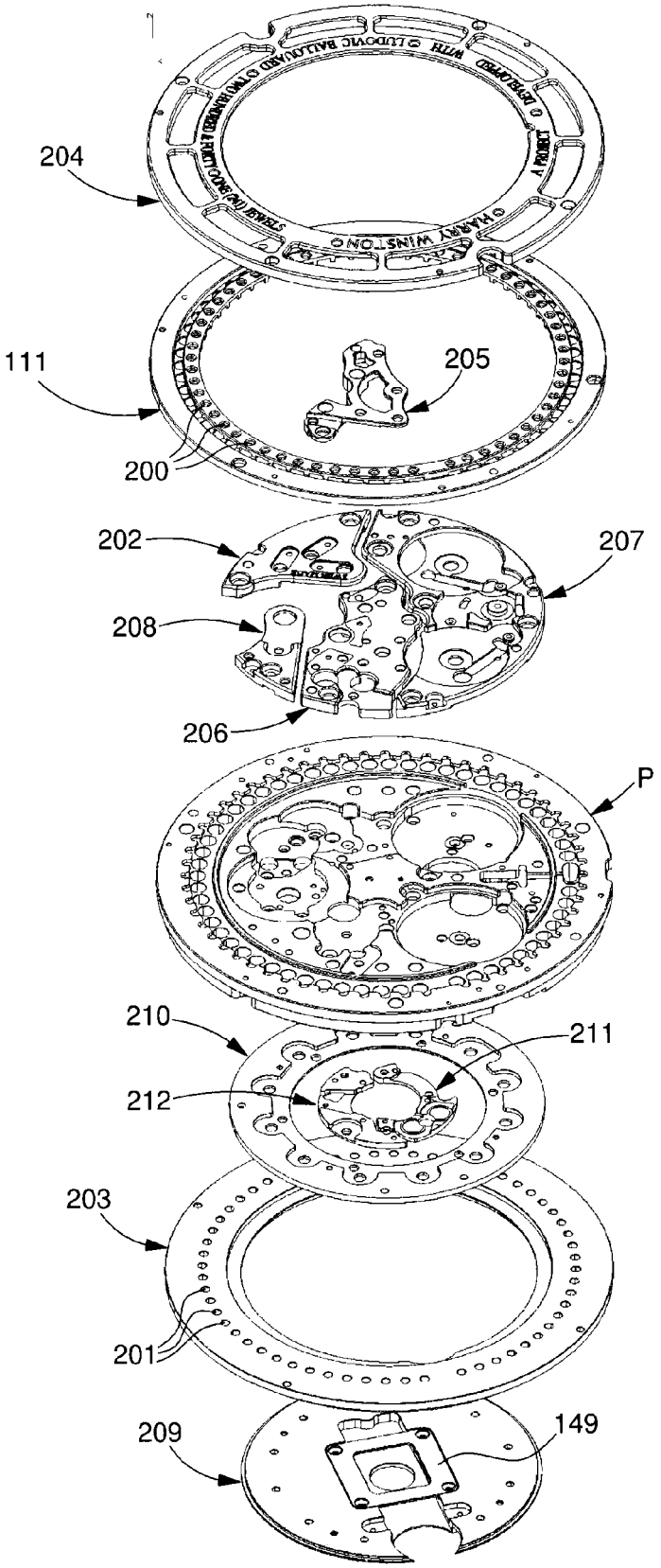
FIG. 11 shows an exploded perspective view of the main plate and the various bars viewed from the back cover side of the timepiece movement of the timepiece of the invention.

In particular, FIG. 3 shows that the movement includes two barrels 100, 101 mounted between plate P and a barrel bar 207 (FIG. 11). A first barrel 100 is dedicated in a conventional manner to driving the gear train and the regulating member (sprung balance) mounted in a conventional manner between plate P and a balance cock 208 (FIG. 11). The second barrel 101 is used for driving the display devices. The two barrels 100, 101 are independently wound by winding stem 102 in its neutral wearing position. The second barrel 101 is wound in the clockwise winding direction, and the first barrel 100 is wound counterclockwise. To achieve this, winding stem 102 is associated with a sliding intermediate wheel 103 including a pinion 104 which meshes with one or other of ratchet wheels 100A, 101A of barrels 100, 101 in the direction of rotation of stem 102. The winding of first barrel 100 is achieved via a direction reversing pinion 105.

Figure 4A:
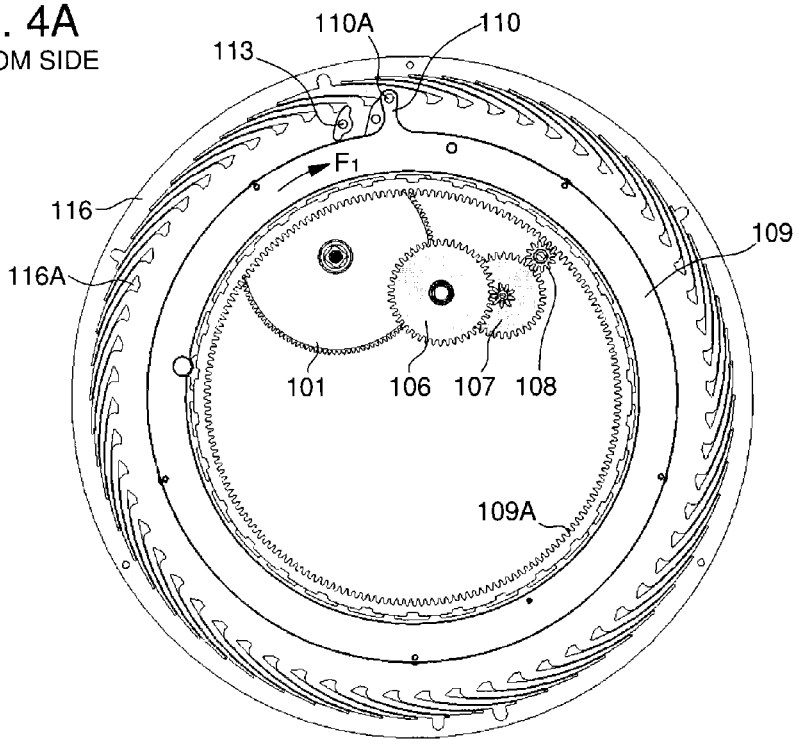
FIG. 4A is a partial illustration, from the back cover side, of the device for driving the minute display member of the timepiece according to the invention.
Figure 5:
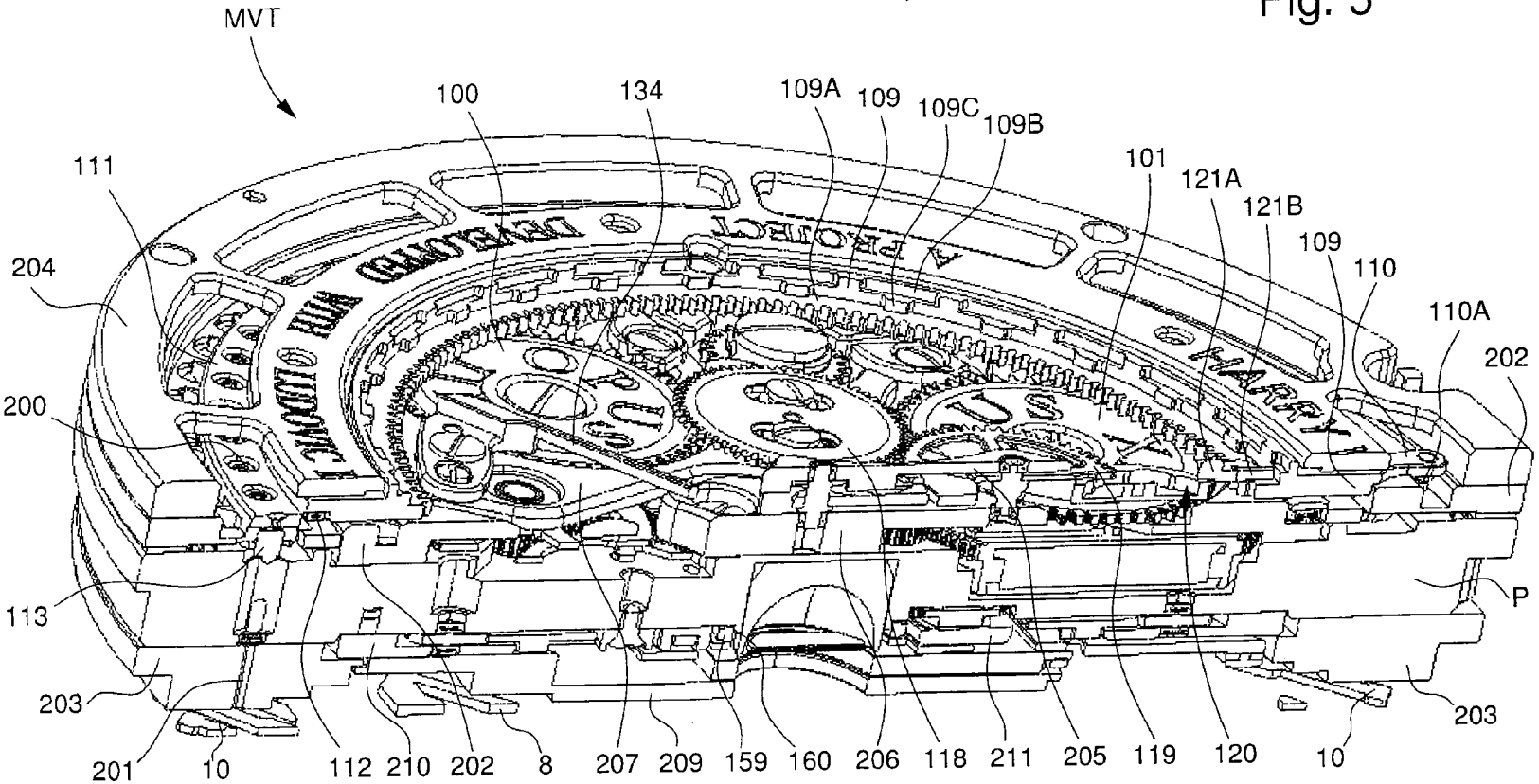
FIG. 5 is a perspective cross-section, on the back cover side, of the timepiece movement according to the invention.

FIG. 4A shows second barrel 101 which, via a train including two wheel sets 106, 107 and a pinion 108, drives the minute control ring 109 in the direction of arrow F1 at the rate of one revolution per hour via inner toothing 109A. Control ring 109 includes a radially extending drive finger 110 at its external periphery. Control ring 109 is guided in rotation between a minute bar 111 and the main plate via intermediate bars (one 202 of which is shown in FIG. 5) by means of preferably ruby guide rollers 112. This control ring 109 is held up by a bar of minute ring 204 (FIG. 11). Drive finger 110 includes a contact pin 110A intended to come into contact with a cam 113 connected to arbours 114 carrying the minute indicators to drive them successively in rotation through a 40° angle.

These arbours 114, which traverse plate P, are pivoted in pairs of ruby bearings respectively driven into orifices 200, 201 of a minute bar 111 and of a display bar 203 arranged on either side of plate P.

Figure 4B:
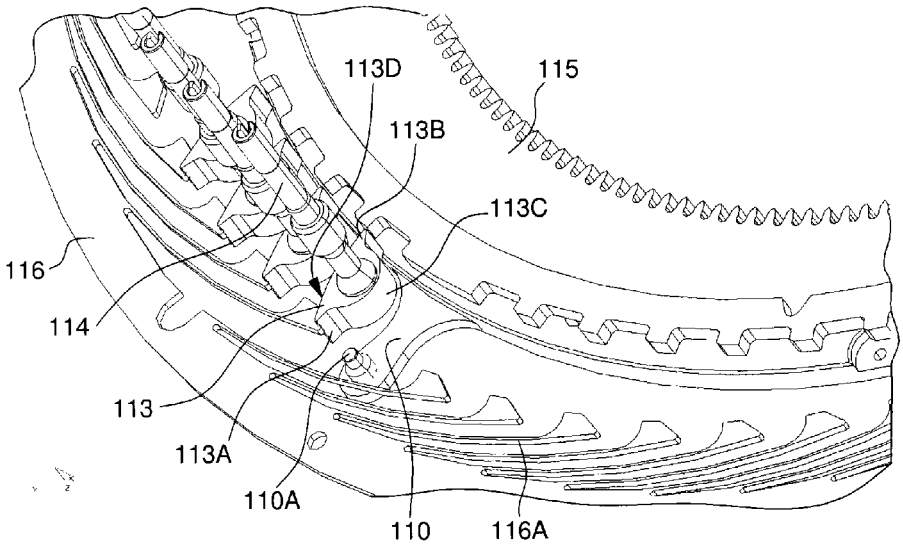
FIGS. 4B and 4C illustrate details, viewed from the dial side, of the drive device for the minute display members of the timepiece according to the invention.
Figure 4C:
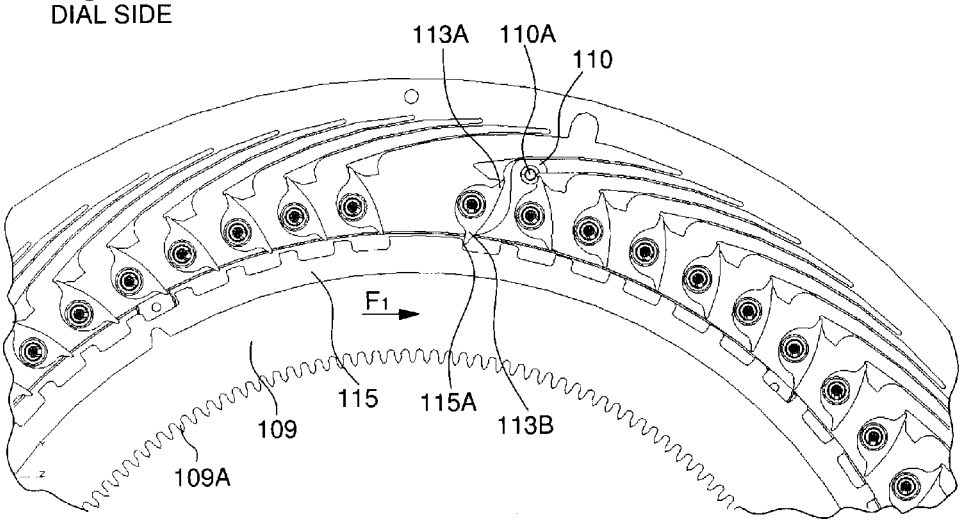

Viewed from above, cam 113 has the general shape of a bicorn including two beaks 113A and 113B connected by two shaped surfaces 113C and 113D. Contact pin 110A enters into contact with beak 113A during its rotation to rotate arbours 114 through a 40° angle. The amplitude of rotation is set by beak 113B which abuts against a flank 115A of an abutment ring 115 including a plurality of stop members defined by the radial flanks of an external slotted toothing having 59 teeth (FIGS. 4B, 4C), one of teeth 115B extending over an angular sector corresponding to two successive teeth. This abutment ring 115 is arranged concentrically to and in a lower plane than control ring 109. This abutment ring 115 has an additional function to the locking function which will be described below. Cam 113 is held in position in the various positions corresponding to those of the minute hands (visible or concealed) by a plurality of springs 116A carried by a jumper spring 116, springs 116A extending from the inner periphery of jumper spring 116 at an angle. There are 59 of these springs, each associated with an assembly comprising cam 113 and minute hand arbour 114.

Figure 6:
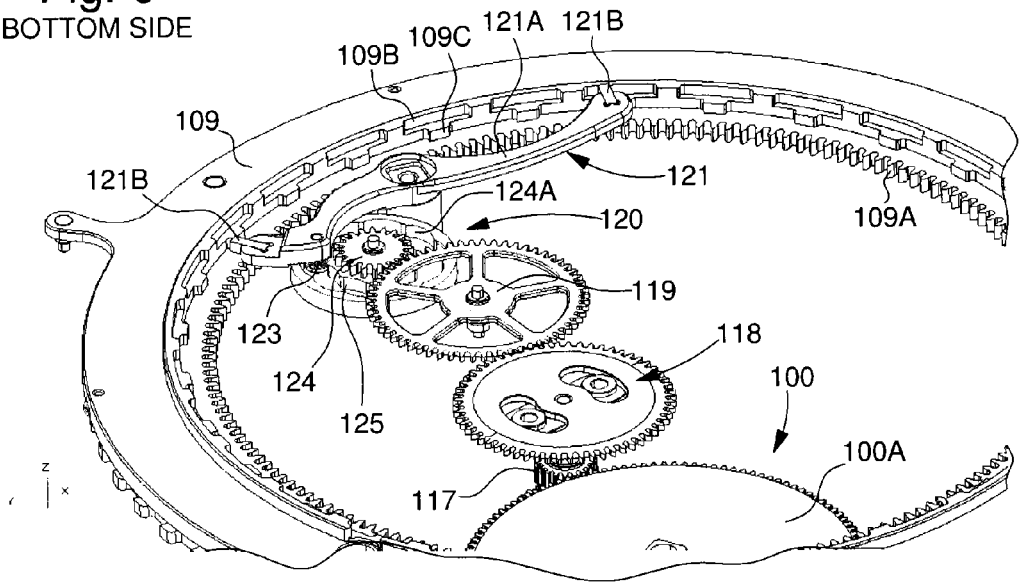
FIGS. 6 and 6A respectively show perspective views of the drive mechanism for the minute display members and a detail thereof viewed from the back cover side of the timepiece of the invention.
Figure 6A:
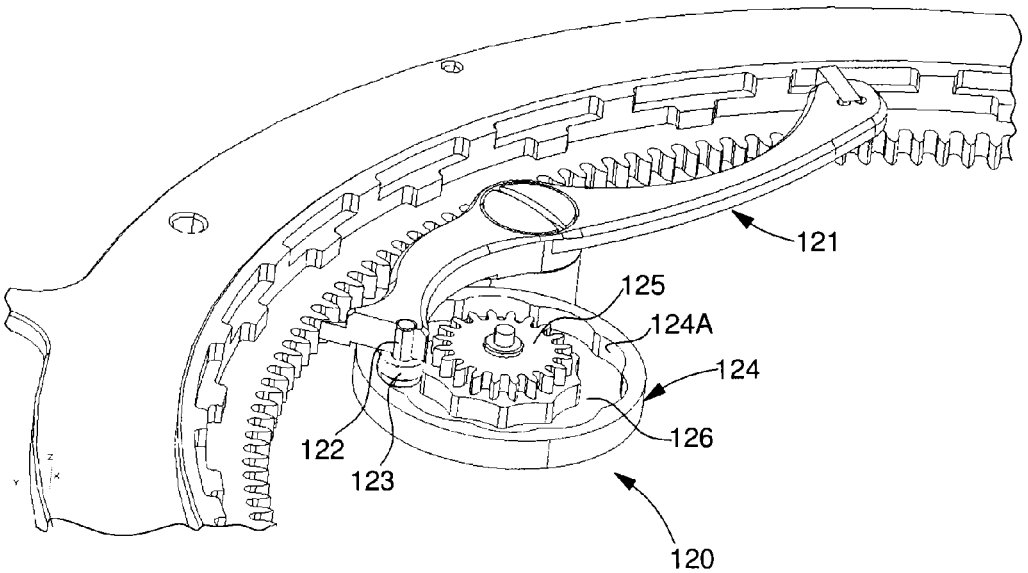

Minute control ring 109 is rotated forward by means of a regulating device allowing the indexed forward motion of control ring 109 in 6° jumps which will be described with reference to FIG. 6. The regulating device is driven by first barrel 100, connected to the gear train and to the regulating member, whose drum 100A is meshed via toothing 100B with a pinion 117 integral with the cannon-pinion (not shown), which carries a sixty wheel 118 making one complete rotation in 60 minutes. Sixty wheel 118 meshes via an intermediate wheel 119 with a control assembly 120 for a lever assembly 121 for stopping/releasing the rotation of control ring 109. Lever assembly 121 is formed of a lever body of generally longitudinal shape. Lever assembly 121 is pivoted between main plate P and a bar (not shown). The body of lever assembly 121 includes at each end thereof a lifting piece 121B cooperating respectively with two superposed inner toothings 109B and 109C arranged above toothing 109A. Lever assembly 121 further includes, in an end portion close to one of lifting pieces 121B, an arbour 122 carrying an annular jewel 123 (FIG. 6A). Annular jewel 123 cooperates with a cam path 124A of a wheel 124 driven by intermediate wheel 119 via a pinion 125 coaxial to wheel 124. In the illustrated example, wheel 124 has a shaped annular hollow 126 defining cam path 124A. The shape of cam path 124A is configured to impart an oscillating motion to lever assembly 121 to alternately stop and release the rotating motion of control ring 109, via the contact between lifting pieces 121B and toothings 109B and 109C of control ring 109.

Figure 7A:
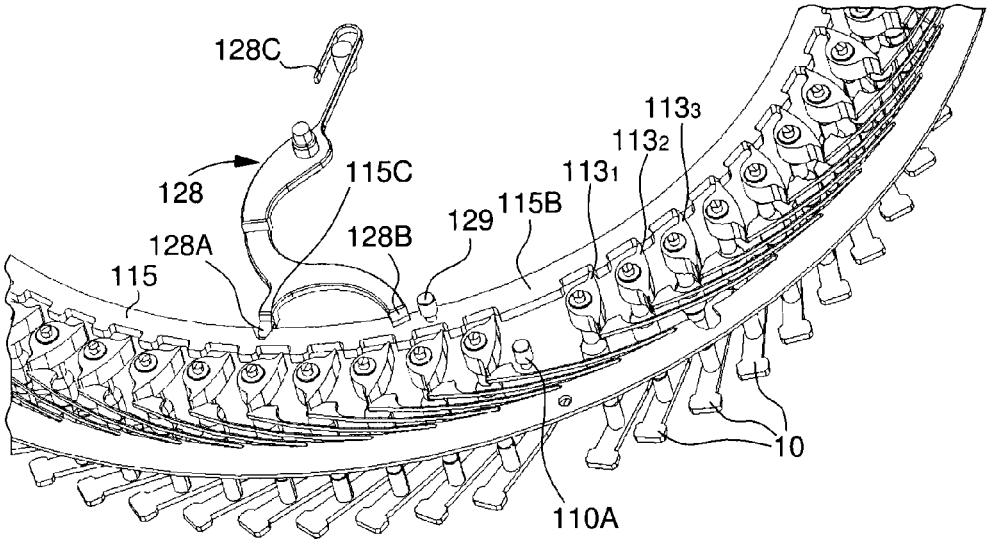
FIGS. 7A and 7B show perspective views of the mechanism for repositioning the minute display members viewed from the back cover side of the timepiece of the invention.
Figure 7B:
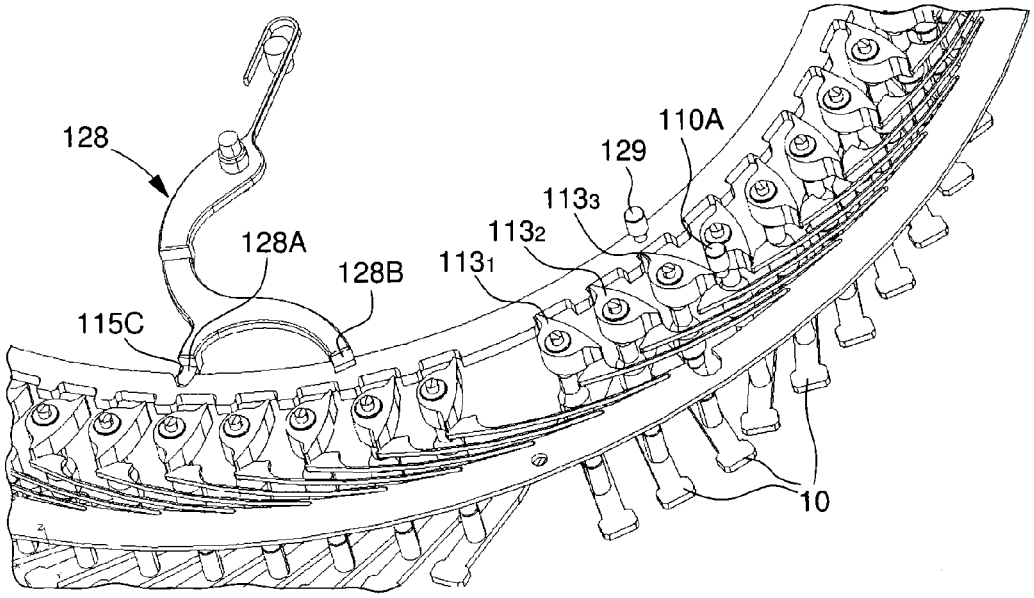

Once the 59 minutes have passed and the 59 minute hands 10 have each passed into their display position via control ring 109, they must be all repositioned in their rest position in which they are concealed from the user before starting a new time cycle. To achieve this, the movement of the invention has a mechanism 127 for repositioning minute hands 10 illustrated in FIGS. 7A, 7B. This repositioning mechanism 127 acts simultaneously on all of cams 113 via abutment ring 115. Repositioning mechanism 127 includes a control and return lever 128 pivoted at A between two bars (not shown). Lever 128 has, at a first end, two arms 128A, 128B in the manner of a fork, and at a second opposite end a return spring 128C bent into a U-shape, this latter being in one piece with the body of lever 128. The end of arm 128A is engaged in a corresponding notch 115C arranged at the inner periphery of abutment ring 115, whereas the end of arm 128B extends between abutment ring 115 and drive ring 109. The latter carries a pin 129 positioned to come into contact once per hour with the end of arm 128B and thus to drive lever 128 in rotation in the direction of arrow F (FIG. 7A) which in turn drives abutment ring 115 via the end of arm 128A. The rotation of abutment ring 115 drives in rotation, via flanks 115A, all of beaks 113B and simultaneously tips them into their rest position in which the hands associated therewith are concealed from the user. More specifically in FIG. 7A, repositioning mechanism 127 is shown after all of the hands have been returned to their concealed position. Pin 129 has just released arm 128B and lever 128 has been returned to its rest position by means of spring 128C. In FIG. 7B, mechanism 127 is shown in a state 3 minutes after the hour. Pin 110A has tipped the first three cams $113_1$, $113_2$, $113_3$ to bring the corresponding hands into their display position.

Figure 8:
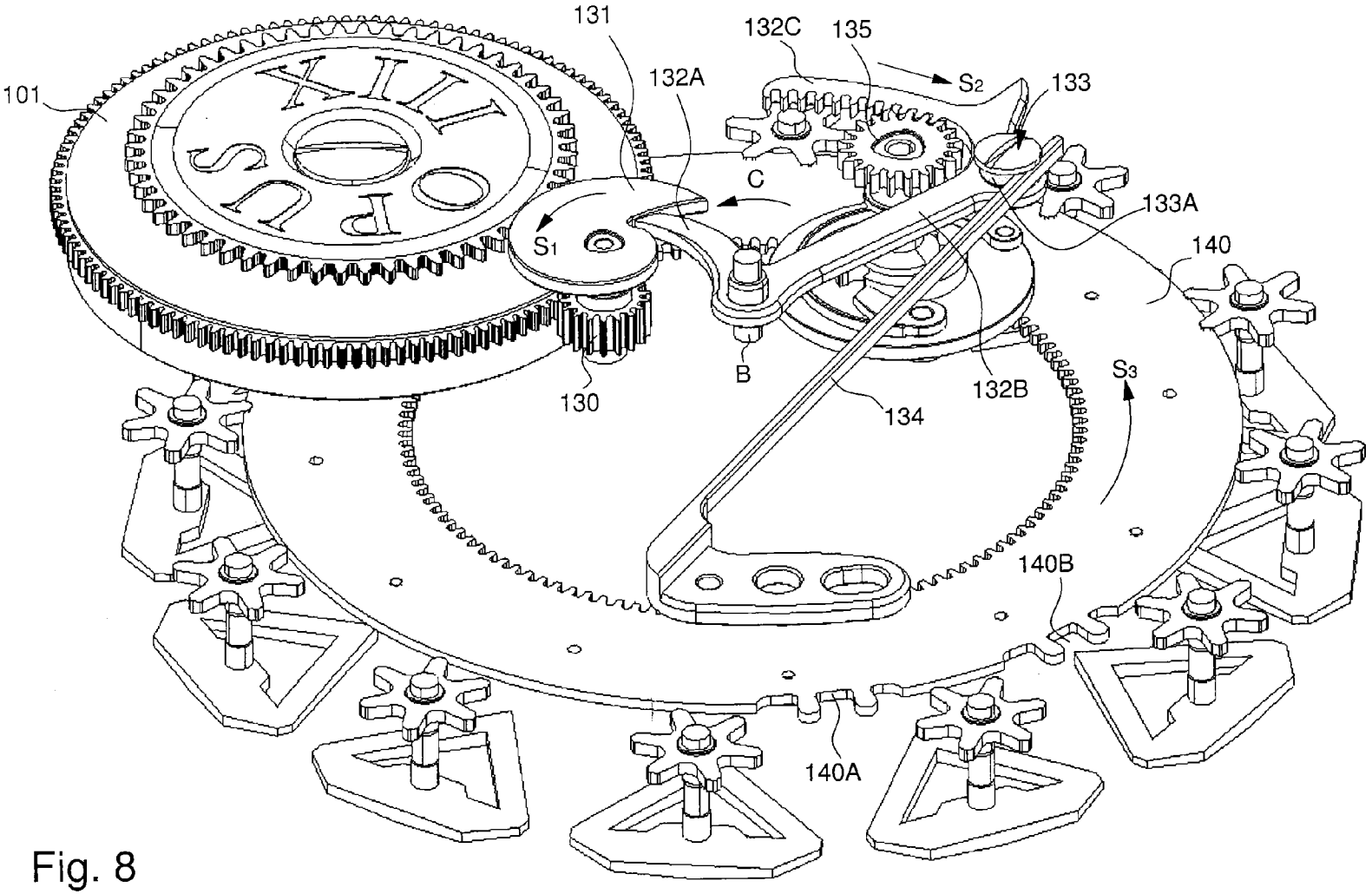
FIGS. 8 and 8A respectively show perspective views of the drive mechanism for the hour display members and a detail thereof, viewed from the back cover side of the timepiece of the invention.
Figure 8A:
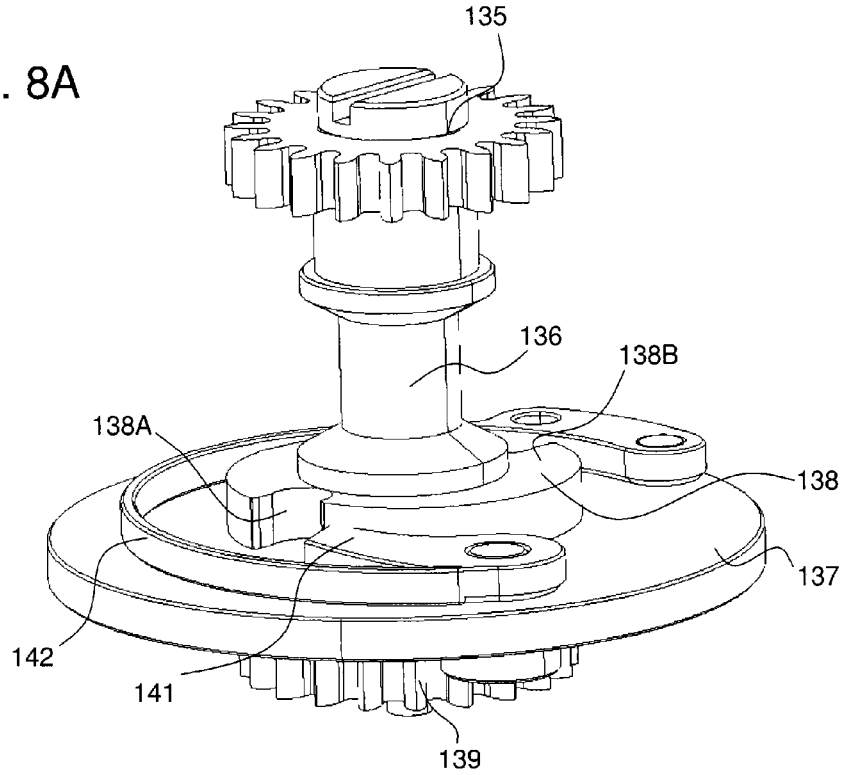
Figure 8B:
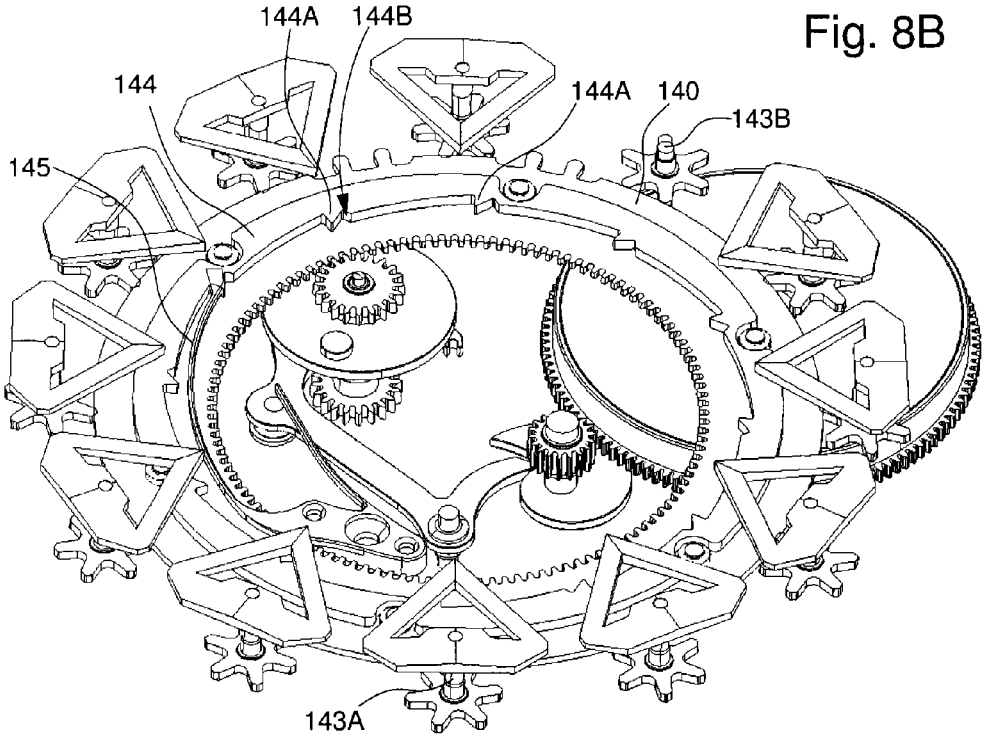
FIG. 8B shows a perspective view of the drive mechanism for the hour display members, seen from the dial side of the timepiece of the invention.

Referring to FIGS. 8, 8A and 8B, the driving of the time indicator members will now be described. A barrel 101 drives a pinion 130 on the arbour of which there is mounted a snail-shaped cam 131, on which the beak of a first arm 132A of a drive lever 132 pivoting at B slides. This drive lever 132 pivots in a pair of ruby bearings respectively driven into a lever bar 205 and a display bar 206 (FIG. 11). Drive lever 132 includes a second arm 132B forming an angle (of around 90° in the illustrated example) with first arm 132A. This second arm 132B is extended by a toothed circular sector 132C centred on pivot pin B. The radial end of second arm 132B carries a stop member 133 provided with a jewel 133A cooperating with a spring 134 returning drive lever 132 in the direction of arrow C (FIG. 8) to maintain a permanent contact between the beak of arm 132A and cam 131. Spring 134 is secured via one end to a bar of the movement. Drive lever 132 also includes a stop member 132D which extends substantially in the radial extension of second arm 132B. Toothed sector 132C meshes with a pinion 135 secured to an arbour 136 mounted to rotate freely in an assembly comprising, secured to each other, a roller 137, a cam 138 and a second drive pinion 139 for the hour control ring 140. Roller 137 also carries a pivotally mounted beak 141 held in contact with cam 138 by a spring 142. This control device allows hour control ring 140 to move forward in jumps, from the continuous rotation of cam 131. Hour control ring 140 includes on the external periphery thereof two toothed sectors 140A, 140B angularly spaced by 30° and each including two teeth in the illustrated example. The toothed sectors mesh in turn with two star wheels 143 having 6 teeth regularly distributed at the periphery of hour control ring 140. Each star wheel 143 is secured to an arbour 143A carrying hour hands 8, with the exception of arbour 143B, which is shorter than arbours 143A and arranged at 12 o'clock and whose display function will be described below. Arbours 143A and arbour 143B are pivoted between pairs of ruby bearings driven respectively into plate P and an hour ring bar 210.

FIG. 8B also shows that drive ring 140 is secured on one face thereof to a non-return ring 144 which is concentric thereto and whose function, via a locking jumper spring 145 secured to plate P, is to lock in rotation drive ring 140 in the direction of arrow S4 after each of the forward jumps of drive ring 140. Jumper spring 145 includes a first locking arm 145A cooperating with non-return ring 144 and a second arm 145B whose function will be explained below with reference to FIG. 10. Non-return 144 includes at the inner periphery thereof twelve toothed sectors 144A wherein each tooth has the shape of a wolf-tooth and a flank 144B which cooperates in abutment with the beak of jumper spring 145.

It goes without saying that, in variant embodiments, the number of teeth of each toothed sector 140A, 140B may be different from two and that star wheels 143 may include a number of teeth different from six depending on the desired angle of rotation of the indicators secured to star wheels 143. Likewise, in another variant, it is possible to provide only one toothed sector 140A on control ring 140. In that case, however, a device for repositioning the display members secured to the star wheels of the type described above will have to be provided.

When snail 131, driven by barrel 101, makes its continuous rotation in the direction of arrow S1, arm 132*a* passes over snail profile 131, causing drive lever 132 to pivot about its pin B in the direction of arrow S2 against the return force of spring 134, until the beak of arm 132A attains the maximum diameter of snail 131, at which moment arm 132A drops along the radial flank of snail 131 to come into contact with the minimum diameter of snail 131. At the same time, drive lever 132 is returned in the direction of arrow C, driving arbour 126 via pinion 135. When one of the two flanks 138A, 138B (FIG. 8A) enters into contact with the assembly comprising roller 137, cam 138 and pinion 139 via beak 141, this assembly is then driven in rotation and pinion 139 drives hour control ring 140 in the direction of arrow S3, so that the two toothed sectors 140A, 140B drives two successive star wheels 143.

Figure 9:
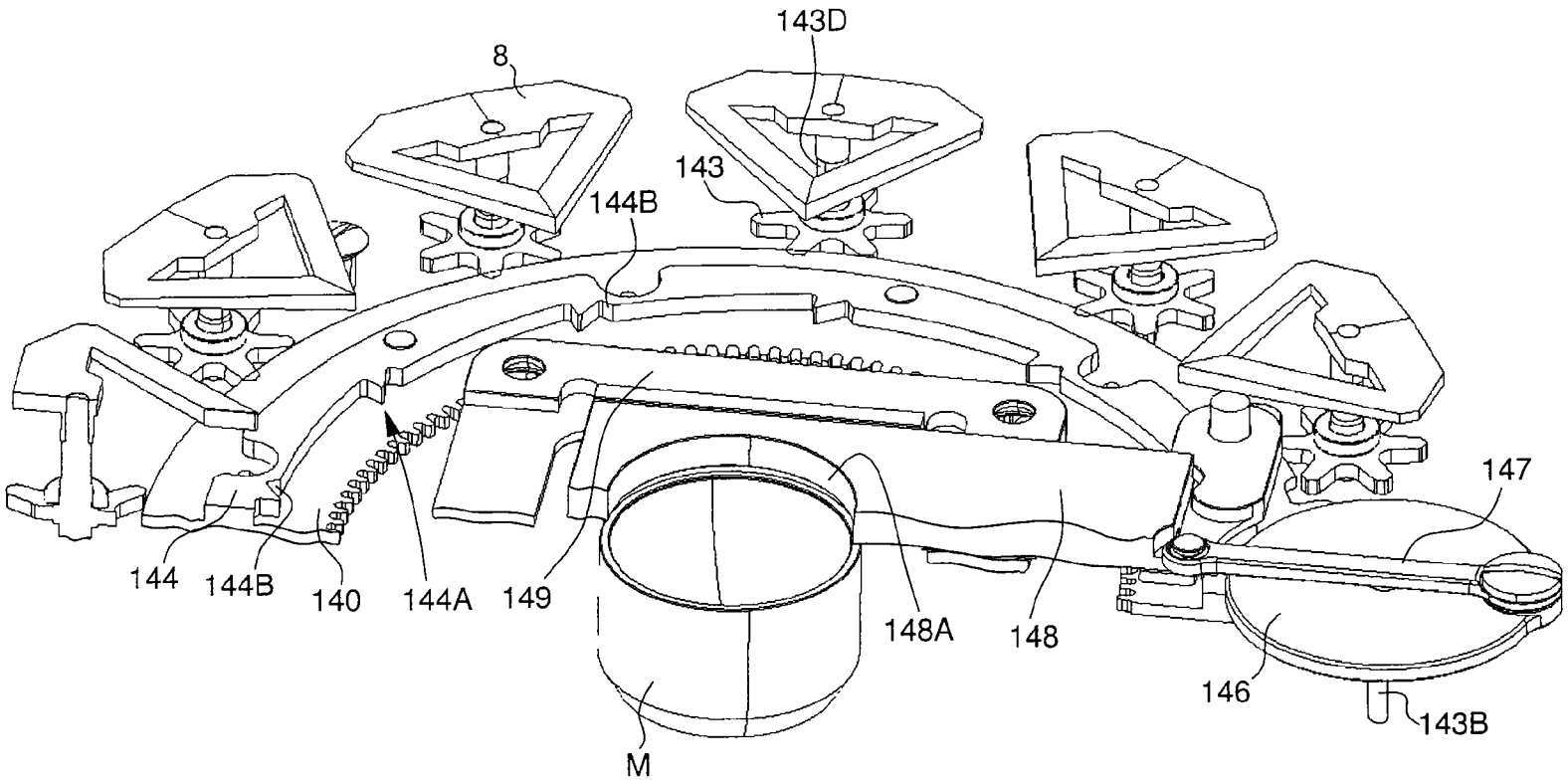
FIG. 9 shows a perspective cross-section of the display mechanism for the 12th hour, viewed from the dial side of the timepiece of the invention.

The 12 o'clock display will be more specifically described now with reference to FIG. 9. Arbour 143B of the 12th hour carries a disc 146 on which there is hinged a connecting rod 147, the other end of which is connected to a hatch 148 sliding in translation in a fixed guide structure 149, preferably provided with a linear ball bearing. Guide structure 149 is mounted on a top hour bar 209 which is fixed to the hour ring bar 210 (FIG. 11). Hatch 148 has a circular aperture 148A. Disc 146 and hands 8 can occupy two fixed positions determined by drive ring 140. In a first position, the aperture of hatch 148 is juxtaposed with a corresponding aperture 3D of dial 3 and reveals an indication M carried by the movement. In a second position, hatch 147 closes aperture 3D. This hatch device 148 is actuated at midday and at midnight, for a period of one hour, and reveals an indication, for example a logo, through the aperture of hatch 148, the aperture of hatch 148 showing the 12 o'clock indication.

Figure 10:
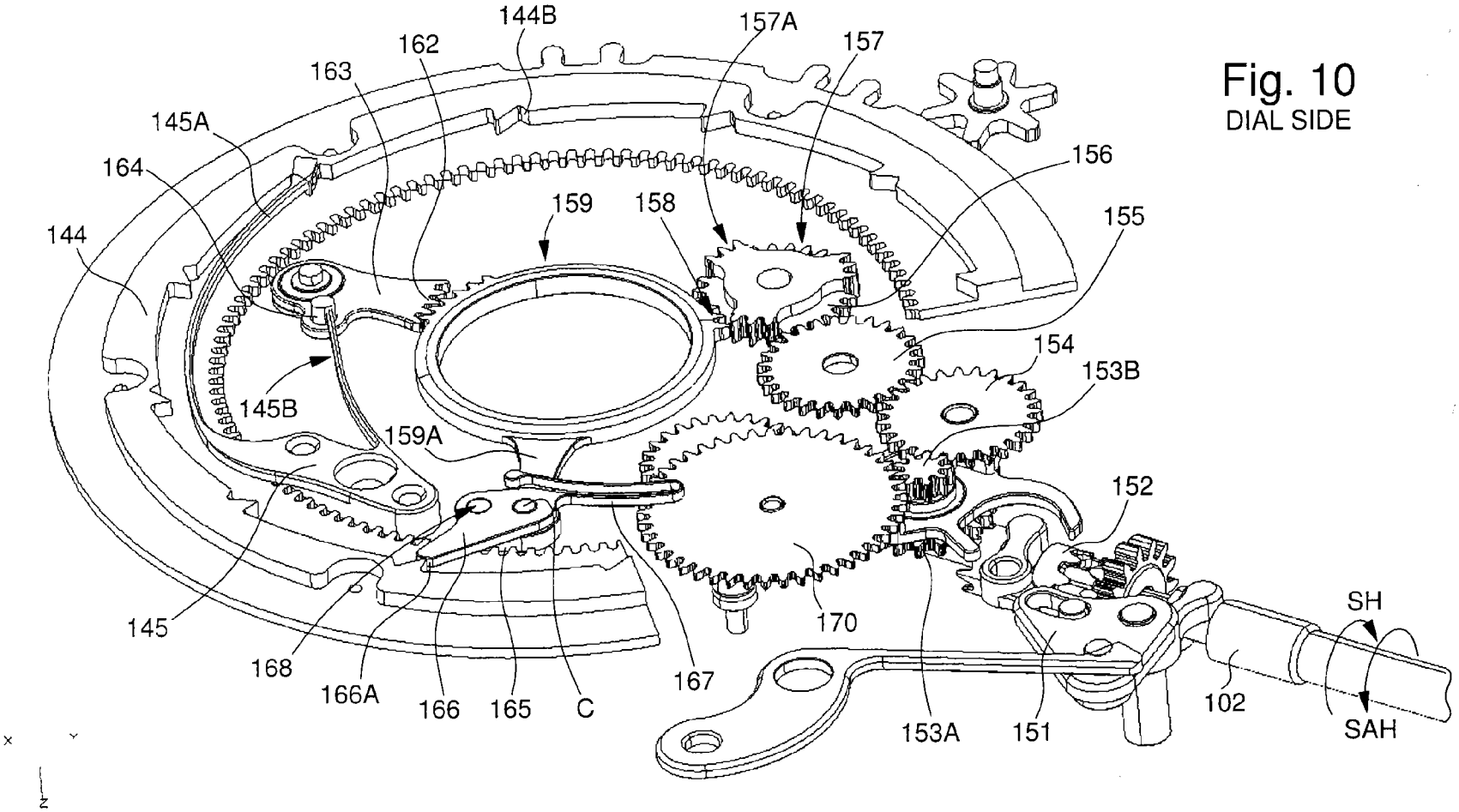
FIG. 10 shows a perspective view of the mechanism for correcting the hour display members, viewed from the dial side of the timepiece of the invention.
Figure 10A:
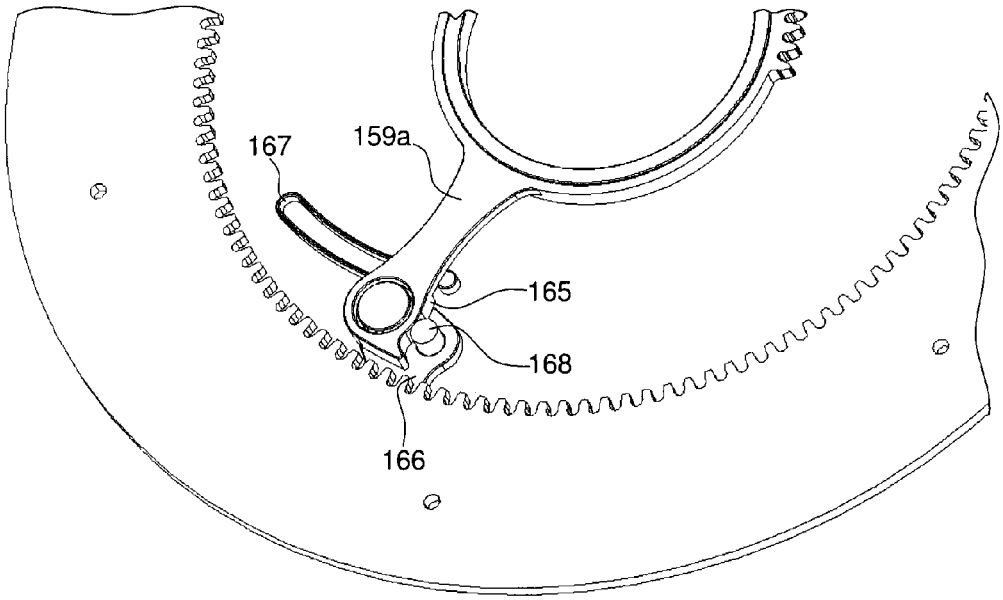
FIG. 10A shows a perspective view of a detail of the mechanism for correcting the hour display members, viewed from the back cover side of the timepiece of the invention.
Figure 10B:
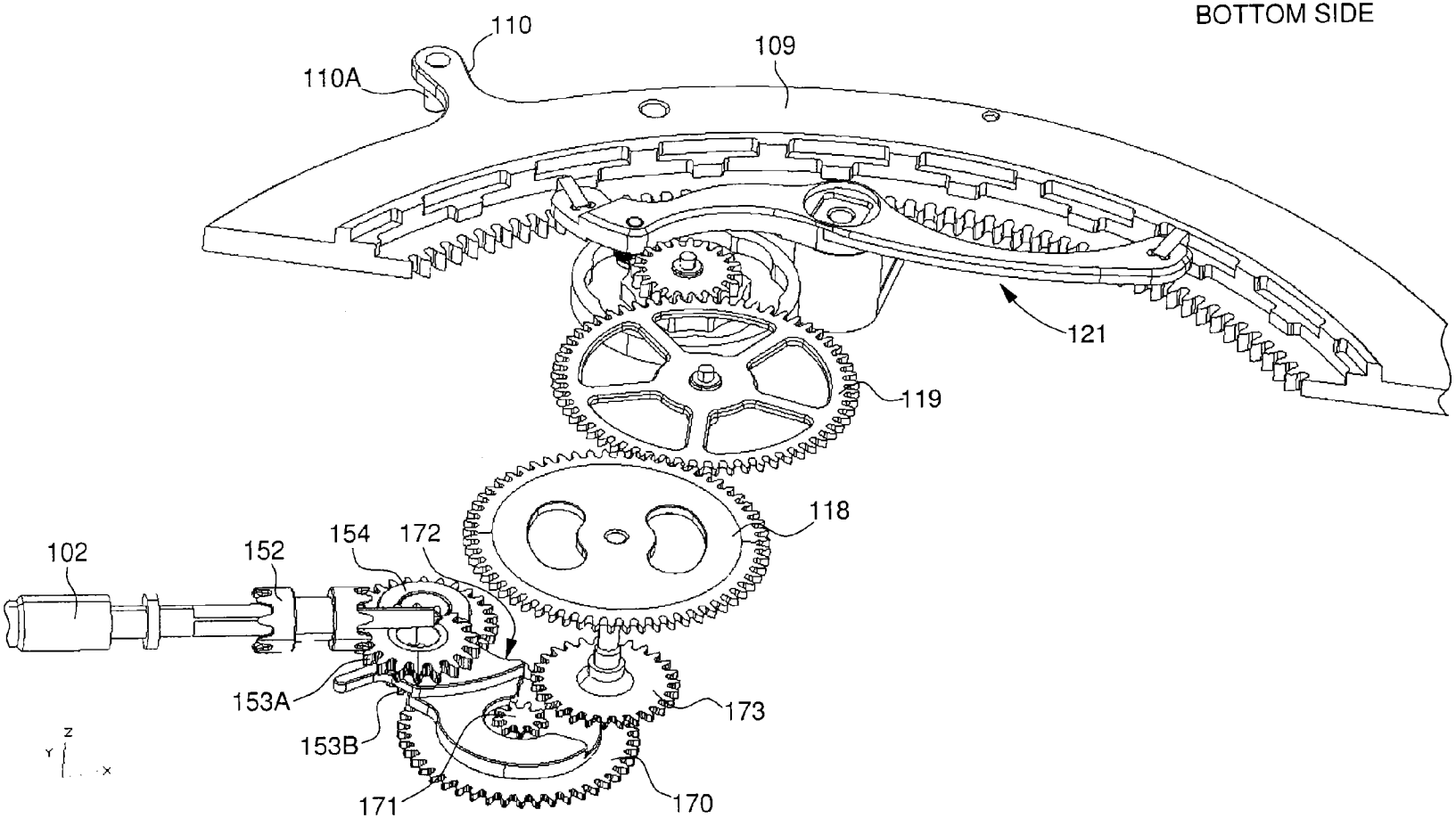
FIG. 10B shows a perspective view of the mechanism for correcting the minute display members, seen from the back cover side of the timepiece of the invention.

Hour and minute correction device 150 will be described with reference to FIGS. 10, 10A and 10B. In addition to its neutral wearing position, winding stem 102 can occupy a pulled-out position in which it allows correction of the hours and minutes.

The hours are corrected by rotating winding stem 102 in the clockwise direction (arrow SH) in the pulled-out position of the stem. Once pulled-out, winding stem 102 actuates lever 151 to position sliding pinion 152 in mesh with wheel set 153 including a wheel 153A and a pinion 153B. Pinion 153B then rotates in the anti-clockwise direction viewed from the dial. Pinion 153B meshes with a gear train including wheels 154, 155, 156. This gear train is pivoted on pins arranged on plate P and is held up by an hour drive bar 211 (FIG. 11). Wheel 156 carries on one face thereof a wheel 157 including three toothed sectors 157A each including three teeth in this example. Wheel 157 is temporarily in mesh with a first toothed sector 158 including, in this example, three teeth of an annular wheel 159 pivoted on a circular wall 160 of plate P. Wheel 159 includes, at an angular distance from first toothed sector 158, a second toothed sector 161 in permanent mesh with a toothed sector 162 integral with a return rack 163 pivoted between plate P and a corrector bar 212 (FIG. 11). Return rack 163 includes a lug carrying a pin 164 extending perpendicularly to the plane of return rack 163 and cooperating with arm 145B of return spring 145. Annular wheel 159 further includes a lug 159A extending radially from the periphery of wheel 159. Toothed sectors 158, 162 and lug 159A are separated by an angle of substantially 120°. Lug 159A ends in a beak 165 extending in a tangential direction to wheel 159. An actuating finger 166 is pivotally mounted at C in the end portion of lug 159A. This finger 166 includes an end portion 166A held in contact with the inner periphery of ring 144 via a spring 167 in abutment against a bar of the plate (not shown). Finger 166 further includes an abutment pin 168 cooperating with beak 165 of lug 159A to limit the angular travel of the finger in relation to lug 159A with reference to FIG. 10A.

When the stem rotates in the clockwise direction, wheel 159 is thus, in a first phase, temporarily driven in rotation over an angular distance in the anticlockwise direction (viewed from the dial) by gear train 153, 154, 155, 156, 157. During this first phase, the end portion 166A of finger 166 is placed in contact with the next plane 144B in the anticlockwise direction. At this stage, toothed sector 158 is unmeshed from the various toothed sectors 157A. In a second phase, return rack 163, moved by the return force of spring 145B, drives wheel 159 in rotation in the clockwise direction (viewed from the dial) and allows ring 144 to be driven in rotation in the clockwise direction via finger 166 which was brought into contact with flank 144*b* in the first phase. The rotation of flank 144 causes the hour display to be driven in correction via toothed sectors 140A, 140B and star wheels 143.

The minutes are corrected by rotating stem 102 in the anticlockwise direction (arrow SAH) in the pulled-out position of the stem. Pinion 153B then rotates in the clockwise direction viewed from the dial and drives wheel 170 integral with a pinion 171 in the anticlockwise direction (viewed from the dial). The assembly comprising wheel 170 and pinion 171 is carried by a sliding gear structure 172, whose centre of rotation merges with the axis of pinion 153B. During the anticlockwise rotation of stem 102, sliding gear structure 172 is angularly moved to bring pinion 171 into mesh with a wheel 173 integral with sixty wheel 118, which drives the minute display mechanism with reference to FIG. 10B.

Referring now to FIG. 11, plate P and the various bars of the movement MVT acting as support for the mechanisms described above are shown in an exploded perspective view.

Figure 12:
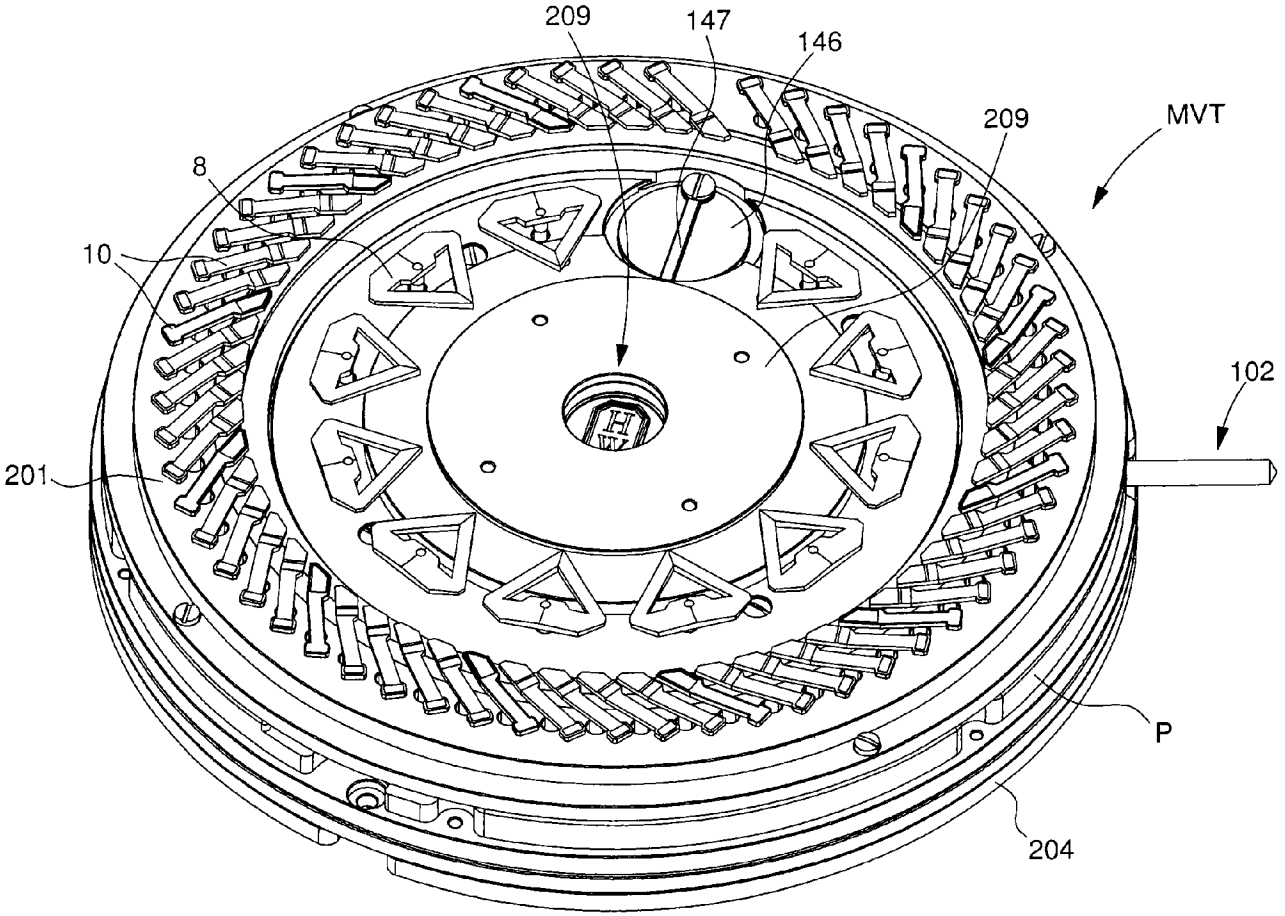
FIGS. 12 and 13 respectively show front views of the timepiece movement of the timepiece of the invention, from the dial side (dial omitted) and from the back cover side.
Figure 13:
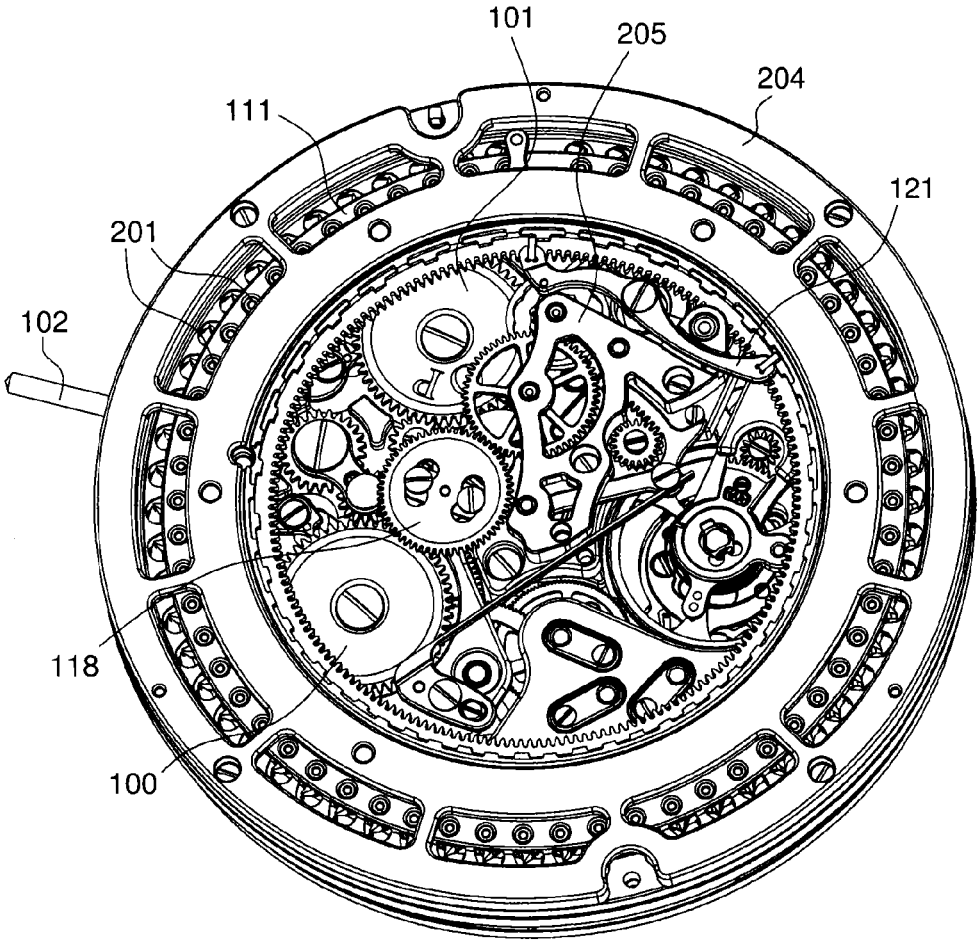

FIGS. 12 and 13 respectively show a front view of the timepiece movement of the timepiece of the invention, from the dial side, with the dial omitted, and from the back cover side.

In a variant embodiment of the invention, the number of hands 10 may be different from 59 and gradually display any type of time or other information/animation, for example each hand could carry a letter or a portion of a message which appears over time or could display the time, the month, the day of the week and/or the date.

What is claimed is:

1. A timepiece including a timepiece movement provided with an information display mechanism driven from a power take-off, said display mechanism including N display members for said information regularly distributed over a perimeter of the movement, wherein the N display members are each pivoted on a drive arbour perpendicularly and can take different first and second radial positions in relation to the centre of the movement, the display members being driven in succession over time by common first annular jumping drive means so that each display member changes in succession from the first position to the second position and is held in said second position until the end of a cycle in which all of the display members are in their second position and in that second annular drive means are arranged to reposition all of the display members in their first position at the start of the following cycle.

2. The timepiece according to claim 1, wherein each of the display members comprises a hand, the two radial positions of the display members being separated from each other by a 40° angle in relation to the drive arbour.

3. The timepiece according to claim 1, wherein the successive driving of the display members is accomplished with a pin secured to first annular drive means, the pin being arranged to push a cam integral with the display member, said cam being associated with a jumper spring to define the first and second positions in a stable manner.

4. The timepiece according to claim 1, wherein the display member displays time information.

5. The timepiece according to claim 1, wherein the timepiece includes 59 display members each defining a different minute.

* * * * *